United States Patent [19]

Bauer et al.

[11] 4,100,659

[45] Jul. 18, 1978

[54] PROCESS FOR TEXTURIZING FILAMENTS

[75] Inventors: Wolfgang Bauer, Heidelberg; Wolfgang Martin, Ludwigshafen; Erwin Lehrer, Bad Durkheim, all of Fed. Rep. of Germany

[73] Assignee: BASF Aktiengesellschaft, Ludwigshafen, Fed. Rep. of Germany

[21] Appl. No.: 754,237

[22] Filed: Dec. 27, 1976

Related U.S. Application Data

[63] Continuation of Ser. No. 555,632, Mar. 5, 1975, abandoned.

[30] Foreign Application Priority Data

Mar. 5, 1974 [DE] Fed. Rep. of Germany ..... 2410429

[51] Int. Cl.[2] ..... D02G 1/12; D02G 1/16; D02G 1/20

[52] U.S. Cl. ..... 28/255; 28/263; 28/271; 57/157 R

[58] Field of Search ..... 28/1.3, 1.4, 1.6, 72.11, 28/72.12, 72.14, 254, 255, 258, 263, 265, 267, 271; 57/34 B, 157 F, 157 R; 555/632

[56] References Cited

U.S. PATENT DOCUMENTS

| | | | |
|---|---|---|---|
| 3,650,001 | 3/1972 | Nikkel | 28/1.6 |
| 3,714,686 | 2/1973 | Schmid et al. | 28/1.4 |
| 3,802,038 | 4/1974 | Bauch et al. | 28/72.11 |
| 3,852,857 | 12/1974 | Ethridge et al. | 28/1.3 |

FOREIGN PATENT DOCUMENTS

| | | | |
|---|---|---|---|
| 2,410,429 | 9/1975 | Fed. Rep. of Germany | 28/255 |

*Primary Examiner*—Louis K. Rimrodt
*Attorney, Agent, or Firm*—Keil, Thompson & Shurtleff

[57] ABSTRACT

A process for crimping filaments by treating the filaments which are to be crimped, and are carried by a heated gas, in a first treatment chamber, and intermingling the heated filaments in an extended second treatment chamber, from which the gas carrier medium is drawn off through longitudinal slots radially to the direction of travel, wherein only sufficient gas is allowed to flow axially with the crimped filaments from the second treatment chamber that the travel of the crimped filaments is not impeded, while the bulk of the carrier gases is drawn off radially from the second treatment chamber. It is advantageous to draw off the carrier gas in the upper part, which comprises from about 25 to 75%, preferably from 40 to 60%, of the total length of the longitudinal slots of the second treatment chamber.

4 Claims, 2 Drawing Figures

PROCESS FOR TEXTURIZING FILAMENTS

Figure 1:
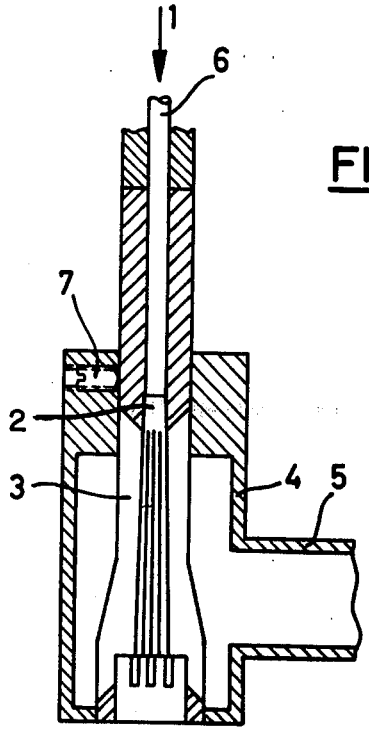

This is a continuation, of application Ser. No. 555,632 filed Mar. 5, 1975, now abandoned.

Numerous processes have been disclosed which permit modification of the structure of the normally smooth filaments of synthetic organic linear high molecular weight materials; these include stuffing box processes, false twist processes and processes wherein the filament is drawn over an edge. Processes in which the filaments are crimped by means of fluid media are also known.

According to the process disclosed in Example 2 of Swiss Pat. No. 378,459 the filament to be crimped is introduced into a treatment chamber by means of a heated fluid medium at a temperature which ensures that the crimp is set. Crimping is effected by accumulating and compressing the filaments in the treatment chamber, from which a part of the fluid medium exits laterally through perforations in the wall, whilst the remainder expels the compressed filaments from the treatment chamber. The above Swiss patent refers to texturizing speeds exceeding 1,000 m/sec, but according to the examples the texturizing is carried out at speeds of from 150 to 600 m/min. Substantially higher speeds are not achievable with the apparatus described in the said patent, since the yarn either no longer accumulates sufficiently and hence becomes insufficiently texturized, or the apparatus becomes blocked and the filament feed therefore ceases.

German Published application No. 2,006,022 discloses a process for the manufacture of texturized filaments of synthetic linear high molecular weight materials in which the filaments are fed through channel-shaped treatment zones where they are exposed to heated fluid media, preferably gases. In this apparatus, the filaments are exposed to the turbulent fluid medium in a filament guide channel in which the filaments are heated to a temperature at which they undergo re-orientation processes, and the fluid medium carries the filaments through the filament guide channel into, and through, a treatment zone with radial longitudinal orifices through which the fluid medium passes radially into the atmosphere, the length of the orifice being set so as to produce continuous compression of the filaments.

German Published application No. 2,016,814 discloses a crimping process similar to that mentioned above, in which a stream of cold gas is blown into the second treatment chamber counter to the take-off direction of the filaments, and both the hot stream of gas travelling in the direction of the yarn and the cold opposite stream exit, or are drawn off, radially from the second treatment chamber.

Finally, German Published application No. 2,111,163 discloses that by using reduced pressure the exit of the two streams of gas mentioned in German Published application No. 2,061,814 can be improved. The processes in which the yarn has to be drawn from the chamber against the cold stream of gas have the disadvantage that the yarn is tensioned whilst still warm. At speeds of 800 m/min or above the tension required to draw off the yarn becomes so high that the crimp of the yarn is virtually annulled again. Since, furthermore, the cooling of the yarns is substantially less at these high speeds, satisfactory crimp rigidities cannot be achieved by this method.

It is an object of the present invention to provide a crimping process in which no blockages occur in the treatment chamber and the yarn is not subjected to tension whilst hot.

It is a further object of the invention to provide a crimping process which gives yarn in which the crimp rigidity is satisfactory even at very high speeds.

We have found that the crimping of filaments by treating the filaments which are to be crimped, and are carried by a heated gas, in a first treatment chamber, and intermingling the heated filaments in an elongate second treatment chamber, from which the gas is drawn off through longitudinal slots radially to the direction of travel, can be improved by only allowing sufficient gas to flow axially with the crimped filaments from the second treatment chamber that the travel of the crimped filaments is not impeded, whilst the bulk of the gas is drawn off radially from the second treatment chamber.

Figure 2:
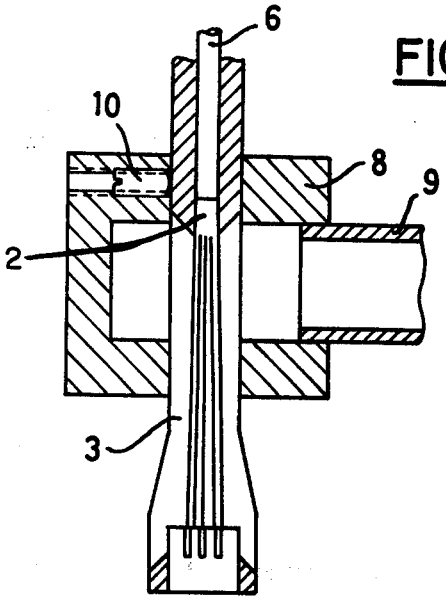

FIGS. 1 and 2 schematically show embodiments suitable for realizing the process.

In contrast to conventional processes, no gas is fed in counter-current to the crimped material. In practice, this situation can be realized very simply by surrounding the slotted part of the second treatment chamber, through which the gas flows radially outward, by a chamber from which gas is drawn off, the rate of suction being adjusted so that the gas which exits axially from the second treatment chamber shows no air motion other than that which results, in any case, from the filament feed. It is relatively simple to adjust the suction since it is directly related to the amount of gas medium introduced. Since the speed of flow of the gas medium is determined by the pressure at which it is fed into the texturizing apparatus and by the dimensions of the apparatus, this pressure can be used as a parameter for adjusting the rate at which the gas medium is drawn off from the second treatment chamber. In general, the input pressures used are from 4 to 8 atmospheres gage. The pressure to be used in drawing off the gas medium radially is from 1 to 90 mm water gage, preferably from 10 to 80 mm water gage, below atmospheric pressure.

The term "filaments" in the present context denotes continuous structures, individual filaments of filament bundles, ribbons, flat filaments or fibers produced by fibrillation from films or strips of film. The fineness of the individual filaments may be, eg., from 1 to 35 dtex; individual filaments of from 10 to 30 dtex are preferred. The number of individual filaments in a filament bundle may be from 2 to several thousand. Filament bundles comprising from 60 to 150 individual continuous filaments are preferred. The filaments in the bundles or yarns may have been drawn or partly drawn when fed to the crimping process. The filaments used may be of round or profiled, for example trilobed, cross-section. At times it may be desirable to impart a certain preliminary twist to the filament bundles, eg. up to 30 turns/m, and in particular up to 25 turns/m. This preliminary twist gives the filament bundles a degree of cohesion so that they are easier to handle.

Synthetic linear or practically linear filament-forming organic high molecular weight materials which may be used to manufacture the filaments are, in particular, the conventional linear synthetic high molecular weight polyamides with recurring amide groups in the backbone, linear synthetic high molecular weight polyesters with recurring ester groupings in the backbone, filament-forming olefin polymers, filament-forming polyacrylonitrile and filament-forming acrylonitrile copolymers containing mainly acrylonitrile units, as well as cellulose derivatives and cellulose esters. Examples of suitable high molecular weight compounds are nylon 6, nylon 6,6, polyethylene terephthalate, linear polyethylene and isotactic polypropylene.

Gas media which may be used are those conventionally employed for filament treatment, eg. nitrogen, carbon dioxide, steam and - particularly for commercial reasons - air. The requisite temperatures of the gas medium may lie within broad limits but temperatures of from 80° to 550° C have proved advantageous. The most advantageous conditions depend specifically on the melting point or plasticizing temperature of the filament-forming materials and on the length of time for which the gas can act on the filaments, on any preheating which may be carried out and on the denier of the filaments. Naturally, the temperatures used must not cause the filaments to fuse under the conditions employed, though the temperatures themselves may be above the melting points or decomposition points of the filament-forming materials used provided that the filaments pass through the treatment zone at a sufficiently high speed, ie. provided the residence time is low. The higher the speed at which the texturizing process is carried out, the greater may be the differential by which the temperature of the texturizing medium exceeds the melting point or decomposition point of the filament-forming material used.

Examples of plasticization temperature ranges are from 80° to 90° C for linear polyethylene, from 80° to 120° C for polypropylene, from 165° to 190° C for nylon 6, from 210° to 240° C for nylon 6,6 from 190° to 230° C for polyethylene terephthalate and from 215° to 255° C for polyacrylonitrile.

If a filament bundle is fed into the crimping apparatus at, eg., 1,600 m/min the temperature of the gas medium may be from 150° to 200° C above the plasticization temperature range of the high molecular weight material used.

As an example, for a 67-filament bundle of nylon 6 of total denier 4,200 dtex, suitable conditions are a feed speed (after the drawing zone) of from 1,600 to 1,800 m/min and a temperature of the gas medium of from 340° to 440° C; after drawing, the filament is advantageously passed over a heated godet at a surface temperature of from 140° to 190° C. The upper temperature limit of the gas medium used is about 550° C and depends on the heat resistance of the materials from which the crimping apparatus is constructed. The optimum temperature differs for various polymers and types of filaments and is easily established experimentally. In deciding the temperature, the amount of gas medium used must also be taken into account. Advantageous amounts to use are from 2 to 15 cubic meters (S.T.P.)/hour, preferably from 4 to 8 cubic meters (S.T.P.)/hour.

According to the invention, the hot gas media are removed radially from the treatment chamber, sufficiently completely that on the one hand there is no significant flow of these gas media with the travel of the crimped textile materials, whilst on the other hand no gas is fed in countercurrent to the crimped material.

It has proved particularly advantageous to draw off radially the bulk of the fluid medium immediately after it enters the second treatment chamber, ie., viewed in the direction of travel of the yarn, over a zone starting from the beginning of the slot and extending over from 25 to 75%, preferably from 40 to 60%, of the slotted length. The total length of the slots as a rule corresponds to from 7 to 20 times, preferably from 10 to 15 times, the internal diameter of the second treatment chamber. As a result of drawing off the gas medium in the first part of the slotted nozzle, a controlled increased compression of the yarn immediately after entering the second treatment chamber occurs. The yarn travels through the remainder of the treatment chamber in the compressed state, as a slub.

The process can be carried out in various apparatuses. FIG. 1 schematically shows an example of a suitable apparatus. The filament is fed, in direction 1, from a conventional first treatment chamber to the second treatment chamber 2. Preferably, the internal cross-section increases abruptly, for example by a factor of from 1.1 to 3.0. The second treatment chamber is provided with slots 3 through which the gas medium is drawn off. For suitable dimensions of the second treatment chamber reference may be made to, eg., U.S. Pat. 3,714,686. A chamber 4, which completely encloses the slotted length of the second treatment chamber 2, surrounds the latter. The gaseous medium is drawn off at a controlled rate through the side-arm 5. The yarn fed in direction 1 passes through the yarn guide tube 6 which preferably widens abruptly, as mentioned above, when it merges with the second treatment chamber 2. The chamber 4 can be fixed in the desired position on the second treatment chamber 2 by means of the setting screw 7. FIG. 2 schematically shows an apparatus for an advantageous embodiment of the process, with the bulk of the gas medium being drawn off immediately after entering the second treatment chamber 2. In this case, the second treatment chamber 2 is surrounded by a short chamber 8 (instead of the chamber 4), which leaves exposed a suitable length of the slots 3. The gas medium is drawn off through the side-arm 9. The position of the chamber 8 relative to the treatment chamber 2 is fixed by means of the setting screw 10. As the position is variable, controlled variation of the rate of suction over the length of the slots is possible.

The process has the advantage over conventional processes that it gives yarns of very good and uniform crimp ridigity at texturizing speeds exceeding 2,000 m/min.

The crimp quality is rated in terms of the crimp rigidity. To determine the latter, the yarn is placed in water at room temperature for 10 minutes, a load of 0.5 p/dtex is then applied, and the load is decreased to 0.001 p/dtex to determine the value of 1. The crimp index is calculated from the equation $$(L - 1/L) \times 100 = \% \text{ (crimp rigidity)}$$

where L is the original length.

EXAMPLE

An unstretched 67-filament nylon-6 yarn of total denier 4,200 dtex is taken from a supply package and fed, via drawing means, to a texturizing apparatus as shown in FIG. 2. The temperature of the godet at the entry to the drawing zone is 80° C, whilst the exit godet is at 160° C. The preheated and drawn filament is fed into the texturizing apparatus at the rate of 1,600 m/min. The air is fed into the apparatus at 360° C and 5.8 atmospheres. The amount of air introduced is 5.5 cubic meters (S.T.P.)/hour. 4.5 cubic meters (S.T.P.)/hour are drawn off from the suction chamber under a pressure of 90 mm water gage below atmospheric pressure.

The second treatment chamber has an internal diameter of 3 mm and is provided with 12 slots. The effective slot length is 39 mm. The chamber surrounding the second treatment chamber, as shown in FIG. 2, is such that the suction is applied to 22 mm of the effective slot length.

The yarn obtained had a uniform crimp and a crimp rigidity of 11.5%.

If, on the other hand, the suction device is omitted, a crimped yarn with a crimp rigidity of 10% is still obtained at a speed of 1,200 m/min, but not at 1,600 m/min, where the crimp rigidity is then only 5%.

We claim:

1. In a process for crimping filaments wherein the filaments are passed through two zones of a treatment chamber by means of a heated carrier gas and wherein carrier gas is removed radially from the second zone of the treatment chamber, the improvement which comprises: adjusting the amount of gas radially drawn off from said second zone whereby substantially no air motion is present at the exit end of the second zone except that resulting from the passage of the crimped filaments, the bulk of said carrier air being removed from substantially the first 75 percent of the total length of the second zone, said filaments being compressed and crimped within said second zone.

2. The process as set forth in claim 1, wherein the input pressure is from 4 to 8 atmospheres gauge and the gas is drawn off radially at a suction pressure of from 1 to 90 mm $H_2O$ gauge below atmospheric pressure.

3. The process as set forth in claim 1, wherein the filaments to be crimped are bundles of 60 to 150 individual continuous filaments.

4. The process as set forth in claim 1, wherein a preliminary twist is imparted to the filaments prior to treatment in the first treatment chamber.

* * * * *